US007547153B2

(12) United States Patent
Yoshioka

(10) Patent No.: US 7,547,153 B2
(45) Date of Patent: Jun. 16, 2009

(54) CUTTER APPARATUS AND PRINTER PROVIDED WITH CUTTER APPARATUS

(75) Inventor: Yukio Yoshioka, Kawasaki (JP)

(73) Assignee: NEC Infrontia Corporation, Kawasaki-Shi (JP)

( * ) Notice: Subject to any disclaimer, the term of this patent is extended or adjusted under 35 U.S.C. 154(b) by 294 days.

(21) Appl. No.: 11/401,873

(22) Filed: Apr. 12, 2006

(65) Prior Publication Data

US 2006/0230956 A1 Oct. 19, 2006

(30) Foreign Application Priority Data

Apr. 13, 2005 (JP) ..... 2005-115622

(51) Int. Cl.
*B41J 11/00* (2006.01)
*B41J 15/18* (2006.01)

(52) U.S. Cl. ..... 400/621; 400/593; 101/226; 83/564

(58) Field of Classification Search ..... 400/621, 400/578, 691, 593; 101/226; 83/564
See application file for complete search history.

(56) References Cited

U.S. PATENT DOCUMENTS 5,727,889 A * 3/1998 Koyabu ..... 400/621
6,361,231 B1 * 3/2002 Sato et al. ..... 400/621
6,447,187 B1 * 9/2002 Robinson ..... 400/621
6,715,948 B2 * 4/2004 Morita et al. ..... 400/621

FOREIGN PATENT DOCUMENTS

| | | |
|---|---|---|
| JP | 2001-121480 | 5/2001 |
| JP | 2002-144655 | 5/2002 |
| JP | 2002-219832 | 8/2002 |
| JP | 2004-237555 | 8/2004 |

* cited by examiner

*Primary Examiner*—Daniel J Colilla
*Assistant Examiner*—Marissa L. Ferguson-Samreth
(74) *Attorney, Agent, or Firm*—Young & Thompson

(57) ABSTRACT

A movable blade unit is fixed to a cutter release lever. The cutter release lever is attached to an upper frame by a cutter supporting point shaft so as to freely oscillate. A latch lever holding the upper frame at a closed position and a cutter lock lever locking the cutter release lever are integrated, and are coupled by an opening and closing lever. If the opening and closing lever is pushed down, the cutter lock lever cancels the lock of the cutter release lever while keeping a state in which the latch lever latches the upper frame. Accordingly, in the movable blade unit, a driving force transmission path between the movable blade unit and a cutter driving motor is disconnected, and a movable blade is returned to a home position by a return spring.

13 Claims, 8 Drawing Sheets

CUTTER APPARATUS AND PRINTER PROVIDED WITH CUTTER APPARATUS

This application claims priority to prior application JP 2005-115622, the disclosure of which is incorporated herein by reference.

BACKGROUND OF THE INVENTION

The present invention relates to a cutter apparatus, and more particularly to a cutter apparatus for a compact printer which is used for an electronic device such as a POS (point of sale) terminal or the like.

The compact printer which is used for the electronic device such as the POS terminal or the like and executes printing on a roll sheet is provided with a cutter apparatus for cutting the printed roll sheet at a proper position (length).

This type of cutter apparatus is structured such as to cut the roll sheet positioned within a paper carrying path by arranging a fixed blade and a movable blade while arranging the paper carrying path therebetween, and moving the movable blade to the fixed blade side. Generally, the fixed blade and the movable blade are respectively attached to a base frame and an upper frame of the printer which are assembled so as to be openable and closable with each other, while taking an easiness for setting the printer to the roll sheet or the like into consideration.

In this case, in this type of cuter apparatus, there is a case that it is impossible to completely cut the roll sheet at a time of cutting the roll sheet, and the roll sheet is tucked down. This is called as a paper jam. In order to solve the paper jam, it is necessary to detach the movable blade from the fixed blade so as to return to a home position.

Since the conventional cutter apparatus quickly return the movable blade to the home position in the case that the paper jam is generated, the conventional cutter apparatus is structured such that the movable blade is returned to the home position by moving the upper frame from a closed state to an open state (for example, refer to Japanese Unexamined Patent Publication No. 2001-121480).

In other words, the conventional cutter apparatus is structured such that the movable blade is provided in the upper frame, a drive source for driving the movable blade is provided in the base frame, a driving force transmission mechanism for transmitting the driving force from the driving source to the movable blade is provided in at least one of the base frame and the upper frame, and a return spring for energizing the movable blade toward the home position is provided. In this structure, when moving the upper frame from the closed state to the open state, a driving force transmission path connecting the movable blade and the driving source is disconnected. Further, the movable blade disconnected from the driving force supplied from the driving source is returned to the home position on the basis of the energizing force of the return spring.

The conventional cutter apparatus is structured such that the driving force transmission path between the driving source and the movable blade is disconnected at a time of moving the upper frame from the closed state to the open state. Accordingly, in the conventional cutter apparatus, there is a problem that the movable blade can be returned to the home position only by opening the upper frame, in the case that the paper jam is generated.

In detail, the movable blade is exposed to the pressure from the fixed blade, in the state of the paper jam. The pressure is transmitted to the upper frame from the movable blade, and transmitted from the upper frame to a latch mechanism latching the upper frame to a closed position, thereby preventing a latch canceling motion of the upper frame. Accordingly, in the state of the paper jam, there is a case that even if it is intended to move the upper frame from the closed state to the open position by operating an opening and closing lever or the like, the upper frame holds the closed state. In this case, the movable blade and the driving source hold being coupled by the driving force transmission path, and it is impossible to return the movable blade to the home position.

Further, since the conventional cutter apparatus is structured as mentioned above, it is necessary to open the upper frame to some degree in order to disconnect the driving force transmission path between the driving source and the movable blade. Accordingly, in the case that the paper jam is generated, it is necessary to open the upper frame until the driving force transmission path is disconnected while keeping a state in which the movable blade protrudes. In this point of view, the conventional cutter apparatus has a problem that a comparatively large space allowing the movement of the protruding movable blade is required above the fixed blade.

SUMMARY OF THE INVENTION

Accordingly, an object of the present invention is to provide a cutter apparatus which can return a movable blade to a home position without opening an upper frame, even in the case that a paper jam is generated.

The present invention is applied to a cutter apparatus comprising an upper frame attached to a base frame so as to be openable and closeable, a movable blade unit provided in the upper frame, and a driving mechanism for transmitting a driving force from a driving source to the movable blade unit.

According to an aspect of the present invention, the movable blade unit is attached to the upper frame so as to be movable. The cutter apparatus is provided with a cutter lock mechanism coupling the movable blade unit to the driving mechanism by locking the movable blade unit, or canceling the coupling between the movable blade unit and the driving mechanism by canceling the lock of the movable blade unit so as to move, in a state in which the upper frame is closed.

In the cutter apparatus according to the present invention, the cutter lock mechanism includes an opening and closing lever allowing the upper frame to move from a closed position to an open position, and the lock of the movable blade unit is canceled on the basis of an operation of the opening and closing lever before the upper frame moves from the closed state to the open state by operating the opening and closing lever.

According to another aspect of the present invention, a printer comprising the above-mentioned cutter apparatus is provided.

According to still another aspect of the present invention, an electronic device comprising the printer mentioned above is provided.

According to the present invention, since the movable blade unit is attached to the upper frame so as to be movable, and the cutter lock mechanism for selectively locking the movable blade unit and canceling the lock is provided, it is possible to provide the cutter apparatus which can return the movable blade to the home position without opening the upper frame even in the case that the paper jam is generated.

Further, according to the present invention, since the structure is made such that the movable blade can be returned to the home position without opening the upper frame even in the case that the paper jam is generated, it is possible to reduce the space required above the movable blade.

DESCRIPTION OF PREFERABLE EMBODIMENTS OF THE INVENTION

Figure 1:
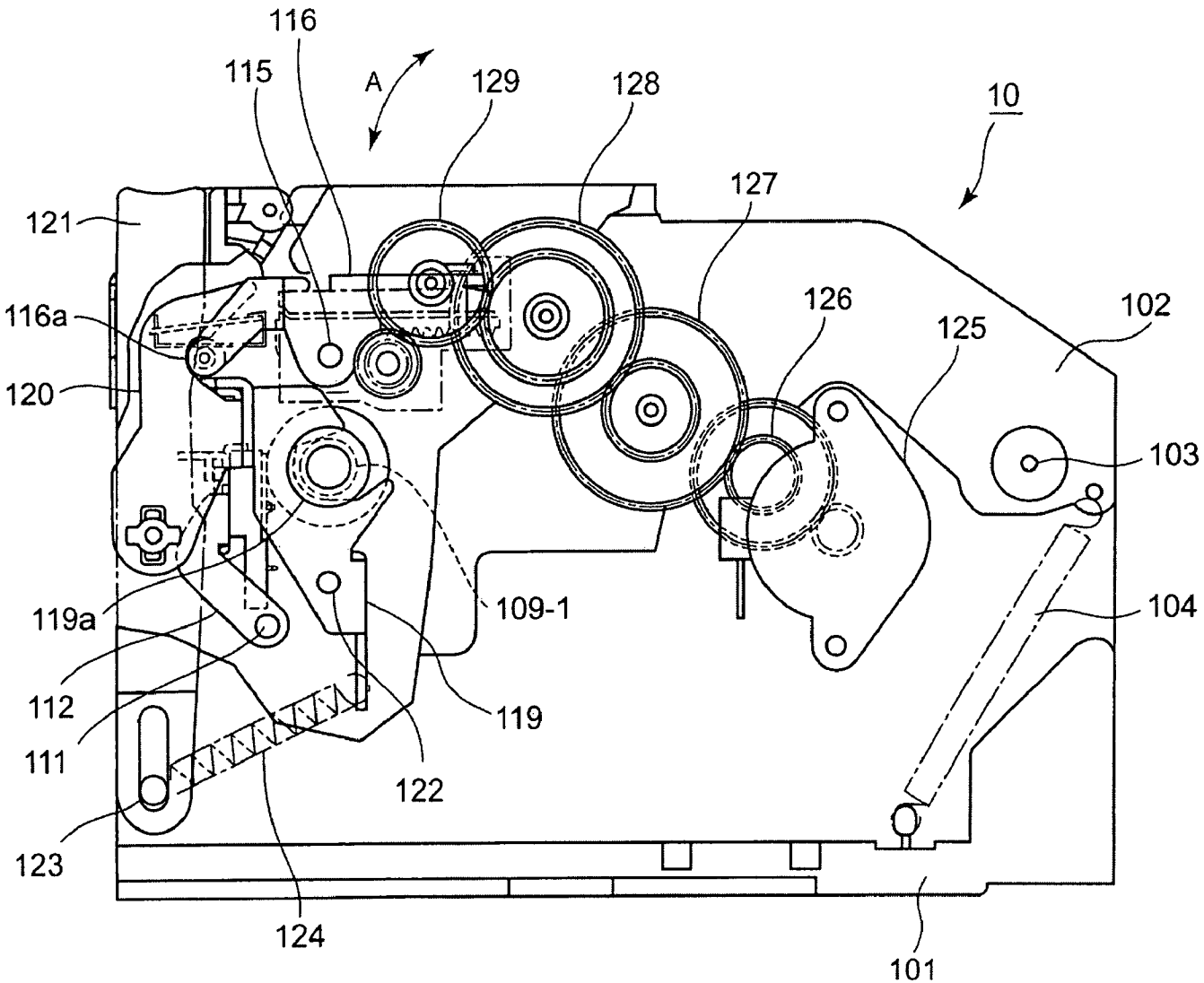
FIG. 1 is a view showing a skeleton structure of a printer according to an embodiment of the present invention.
Figure 2:
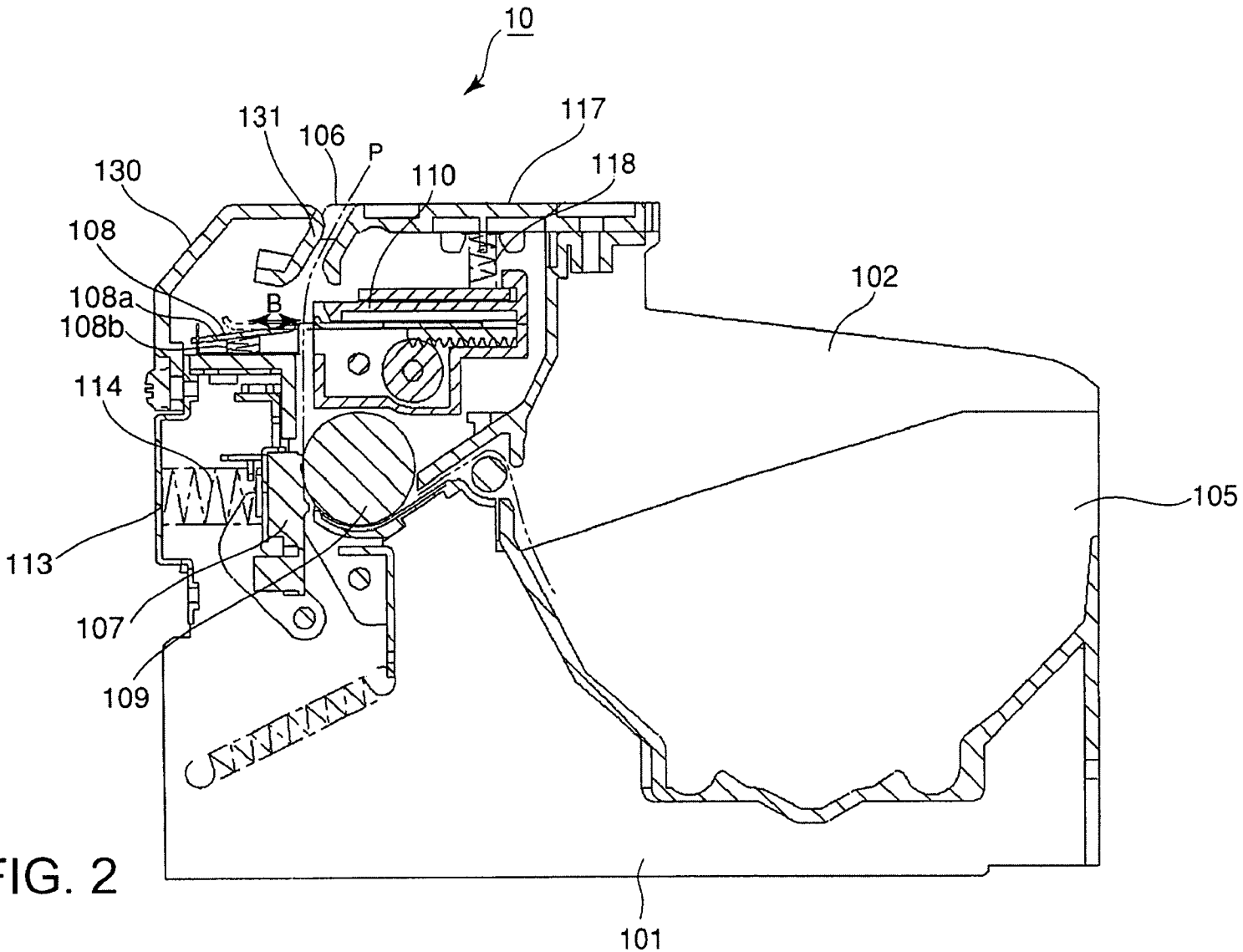
FIG. 2 is a vertical cross sectional view of a center portion of the printer shown in FIG. 1.

FIG. 1 shows a structure of a printer 10 according to an embodiment of the present invention. FIG. 2 is a vertical cross sectional view of a center portion of the printer shown in FIG. 1. In this case, the printer 10 is constituted by a simple printer or a printer which is built in an electronic device such as a POS terminal, a handy terminal or the like.

With reference to FIGS. 1 and 2, the printer 10 has a base frame 101 and an upper frame 102. The upper frame 102 is attached to the base frame 101 via an opening and closing shaft 103 extending in a front and back direction of the drawing so as to be openable and closeable. In other words, the upper frame 102 can movable in a direction along an arrow A shown in FIG. 1. Further, an opening and closing spring 104 always energizing the upper frame 102 in an opening direction is provided between the base frame 101 and the upper frame 102.

As shown in FIGS. 1 and 2, when the upper frame 102 is at the closed position, a paper storage chamber 105 accommodating a roll sheet (hereinafter, refer to as a paper), and a paper carrying path P (shown by a two-dot chain line in FIG. 2) extending from the paper storage camber 105 to a paper discharge port 106 are formed between the base frame 101 and the upper frame 102. In this case, a thermal printing is employed as a printing mode in the present embodiment. In this case, a heat sensitive roll sheet is employed as the paper, and a thermal head is employed as a print head. A thermal head 107 and a fixed blade unit 108 are provided in the base frame 101 along the paper carrying path P, and a platen 109 and a movable blade unit 110 are provided in the upper frame 102.

In detail, the thermal head 107 is fixed to a head bracket 112 which is rotatably attached to the base frame 101 via a head bracket supporting point shaft 111 extending along the front and back direction of the drawing. A thermal head pressing spring 114 is arranged between the head bracket 112 and a spring pressing plate 113 fixed to the base frame 101. The thermal head pressing spring 114 always energizes the head bracket 112 and the thermal head 107 to the platen 109 side.

Further, the fixed blade unit 108 has a fixed blade 108*a*, and a spring 108*b* elastically supporting the fixed blade 108*a*.

The platen 109 has a platen shaft 109-1 extending along the front and back direction of the drawing, and is rotatably pivoted to the upper frame 102.

The movable blade unit 110 is fixed to a cutter release lever 116 attached to the upper frame 102 via a cutter supporting shaft 115 extending along the front and back direction of the drawing so as to freely oscillate (freely move). A cutter release spring 118 is arranged between the cutter release lever 116 and a top cover 117 fixed to the upper frame 102. The cutter release spring 118 always energizes the cutter release lever 116 in such a manner that a cutting edge side end portion of the movable blade unit 110 moves apart from the fixed blade unit 108.

The base frame 101 is further provided with a latch lever 119 for latching the upper frame 102 to the closed position, a cutter lock lever 120 for locking the movable blade unit 110, and an opening and closing lever 121 for canceling the latch by the latch lever 119.

The latch lever 119 and the cutter lock lever 120 are integrated (integrally formed) with each other, and are rotatably attached to the base frame 101 via a latch lever shaft 122 extending in the front and back direction of the drawing. Further, the integrated latch lever 119 and cutter lock lever 120 are rotatably coupled to the opening and closing lever 121. The opening and closing lever 121 is attached to the base frame 101 in a state in which the movement thereof is limited by an opening and closing lever shaft 123 provided in the base frame 101.

A lock spring 124 is provided between the opening and closing lever shaft 123 and the latch lever 119. The lock spring 124 always energizes the latch lever 119 in a direction of latching the upper frame 102 to the closed position. In accordance with this, the cutter lock lever 120 is always energized in a direction of locking the movable blade unit 110. Further, the opening and closing lever 121 is also exposed to the force from the lock spring 124 via the integrated latch lever 119 and cutter lock lever 120, and is always energized toward an upper side in the drawing.

The base frame 101 is further provided with a cutter driving motor 125 serving as a driving source for driving the movable blade unit 110. Further, the base frame 101 and the upper frame 102 are provided with first to fourth driving force transmission gears 126, 127, 128 and 129 serving as a driving force transmission path for transmitting the driving force from the cutter driving motor 125 to the movable blade unit 110.

Further, the base frame 101 is provided with a cutter cover 130 covering an upper side of the fixed blade unit 108, and a paper discharge guide 131 preventing the paper from going into the cutter cover 130.

In the structure mentioned above, the cutter apparatus is constituted by the base frame 101, the upper frame 102, the fixed blade unit 108, the movable blade unit 110, the cutter release lever 116, the cuter release spring 118, the integrated latch lever 119 and cutter lock lever 120, and the opening and closing lever 121. Further, among them, the cutter lock mechanism is constituted by the cutter release lever 116, the cutter release spring 118, the integrated latch lever 119 and cutter lock lever 120, and the opening and closing lever 121.

Next, a description will be given of an operation of the printer 10 with reference to the FIGS. 3*a* to 7 in addition to FIGS. 1 and 2.

FIGS. 1 and 2 show the printer 10 at a time of being generally used. In this case, an illustration of the paper is omitted.

In the state shown in FIGS. 1 and 2, the latch lever 119 latches the upper frame 102 to the closed position by the energizing force of the lock spring 124. In other words, an approximately U-shaped platen bearing 119*a* of the latch lever 119 supports the platen shaft 109-1 in the platen 109. In other words, the platen bearing 119*a* locks the platen shaft 109-1 at the position. Accordingly, the upper frame 102 is latched at a position closed with respect to the base frame 101 against the energizing force of the opening and closing spring 104. At this time, the cutter lock lever 120 presses a roller 116*a* attached to a leading end of the cutter release lever 116 against the energizing force of the cutter release spring 118, and locks the movable blade unit 110.

Further, the thermal head 107 is energized to the platen 109 side by the thermal head pressing spring 114, and is pressed against a front surface of the paper a back surface of which is supported by the platen 109 by a predetermined pressure. Further, the thermal head 107 executes printing with respect to the pressed paper. At this time, the platen 109 rotates in such a manner as to carry the paper to the upper side in the drawing at a carrying speed in correspondence to a printing speed of the thermal head 107.

If the paper is carried at a predetermined length after the printing is finished, the movable blade unit 110 is driven for cutting the paper.

Figure 3A:
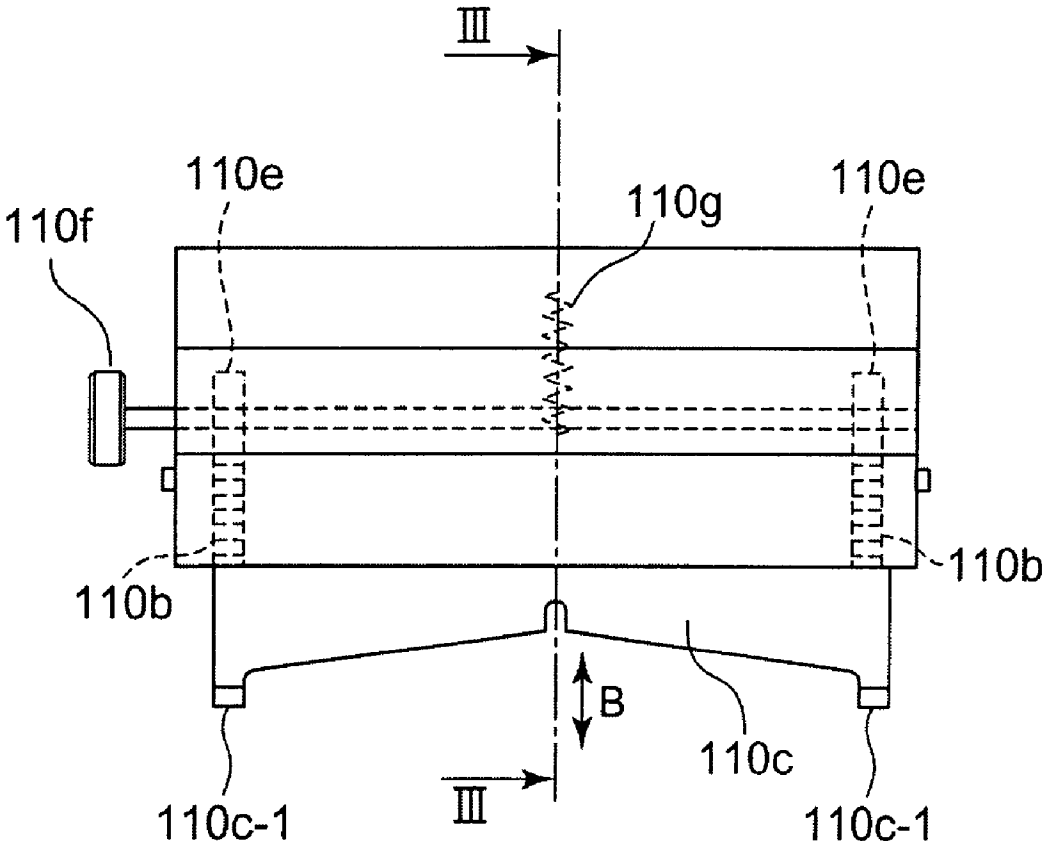
FIG. 3*a* is a plan view of a movable blade unit used for the printer in FIG. 1.
Figure 3B:
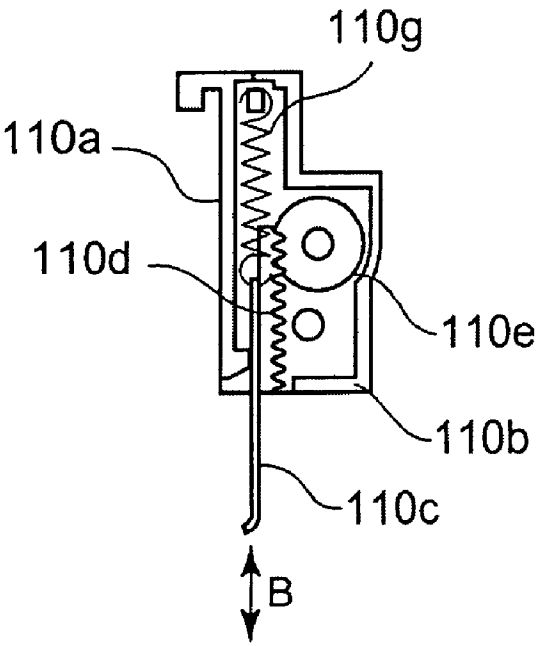
FIG. 3*b* is a cross sectional view along a line III-III in FIG. 3*a;*

The movable blade unit 110 has a pair of cutter frames 110*a* and 110*b* which are combined with each other, and a movable blade 110*c* which is accommodated in an internal space formed by the cutter frames 110*a* and 110*b* except a part (a guide portion) thereof, as shown in FIGS. 3*a* and 3*b*. Further, the movable blade unit 110 has a rack 110*d* fixed to the movable blade 110*c*, a pinion 110*e* rotatably attached to the cutter frame 110*b* and engaging with the rack 110*d*, and a cutter gear 110*f* fixed to a shaft of the pinion 110*e*, for taking the movable blade 110*c* in and out (moving along a direction of an arrow B in the drawing) from the internal space formed by the cutter frames 110*a* and 110*b*. Further, the movable blade unit 110 has a return spring 110*g* which accommodates the movable blade 110*c* in the internal space formed by the cutter frames 110*a* and 110*b* in the case that the cutter gear 110*f* is in a free state, and is structured such that one end is fixed to a rear end of the movable blade 110*c* and the other end is fixed to the cutter frame 110*a* (or 110*b*), for returning to a position called as a home position.

With reference to FIGS. 1 and 2 again, when the movable blade unit 110 is locked by the cutter lock lever 120, the cutter gear 110*f* is engaged with the fourth driving force transmission gear 129. In this state, when the cutter driving motor 125 is normally rotated, the driving force is transmitted to the cutter gear 110*f* via the first to fourth driving force transmission gears 126 to 129. As a result, the movable blade 110*c* protrudes toward the fixed blade 108*a* (toward a left side in FIG. 2). In this case, the cutting edge of the fixed blade 108*a* is at a position slightly higher than the cutting edge of the protruding movable blade 110*c*. The guide portion 110*c*-1 is formed in both sides in the cutting edge side of the movable blade 110*c*, and the guide portion 110*c*-1 pushes down the fixed blade 108*a* against the energizing force of the spring 108*b*. As a result, the cutting edge of the movable blade 110*c* is at substantially the same height position as the cutting edge of the fixed blade 108*a*, and can pinch and cut the paper positioned therebetween. Thereafter, if the cutter driving motor 125 is reversely rotated, the driving force is transmitted to the cutter gear 110*f* via the first to fourth driving force transmission gears 126 to 129, and the movable blade 110*c* is pulled back to the home position.

The above is the normal operation of the printer 10, however, in the case that the cutting of the paper can not be normally executed, there is a case that the paper jam that the paper is wedged between the fixed blade 108*a* and the movable blade 110*c* is generated. If the paper jam is generated, the force which the movable blade 110*c* receives from the fixed blade 108*a* becomes strong, on the basis of the existence of the paper. As a result, there is a case that the movable blade 110*c* can not return to the home position on the basis of the driving force of the cutter driving motor 125. In the case mentioned above, an operator pushes down the opening and closing lever 121. The opening and closing lever 121 can be pushed down by a comparatively weak force at the start, however, a comparatively strong force is necessary halfway. This is because the inner portion of the printer 10 changes in two stages on the basis of a push-down degree of the opening and closing lever 121. A description will be given below of these two change stages individually.

Figure 4:
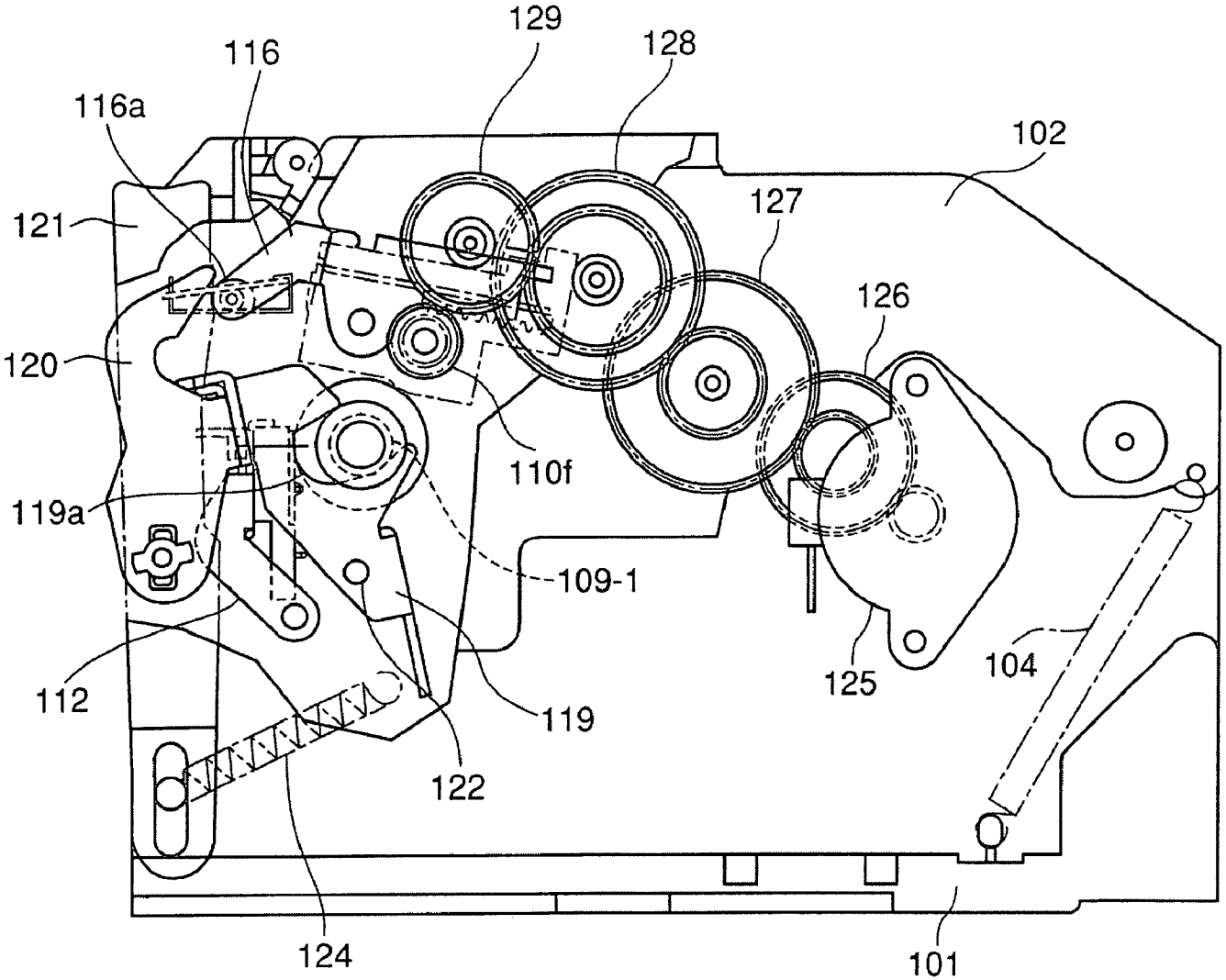
FIG. 4 is a view for explaining a state in which an opening and closing lever of the printer in FIG. 1 is pushed down to a first stage.
Figure 5:
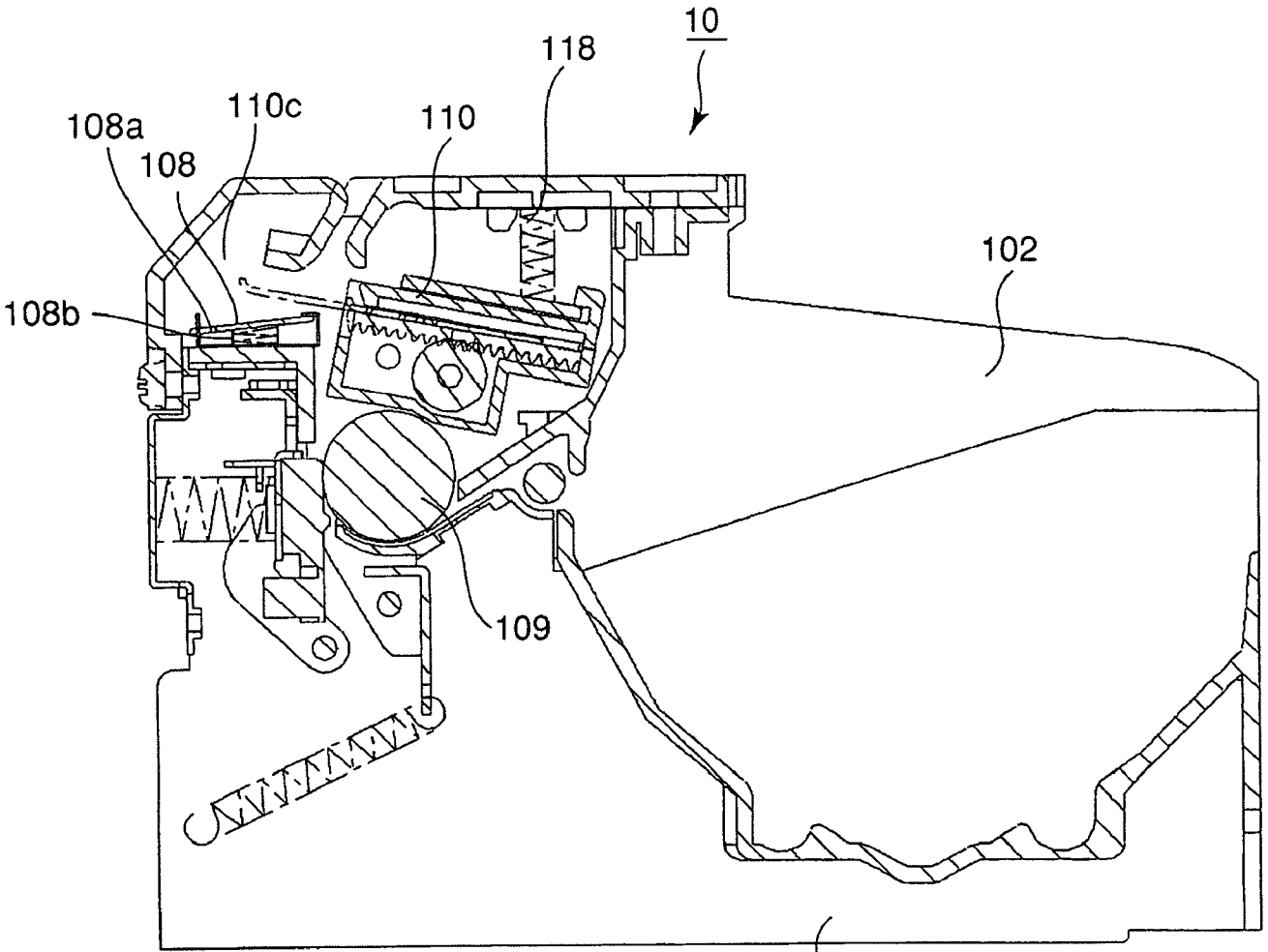
FIG. 5 is a vertical cross sectional view of the center portion of the printer in the state shown in FIG. 4.

FIGS. 4 and 5 show a state of the printer 10 at a time when the opening and closing lever 121 is pushed down by the comparatively weak force.

When pushing down the opening and closing lever 121 by the comparatively weak force, the integrated latch lever 119 and cutter lock lever 120 rotate around the latch lever shaft 122 serving as a rotational axis against the energizing force of the lock spring 124 in correspondence therewith. Further, a part of the integrated latch lever 119 and cutter lock lever 120 strike against a part of the head bracket 112, and the opening and closing lever 121 can be pushed up more only by applying a stronger force. FIGS. 4 and 5 show a state in which a part of the integrated latch lever 119 and cutter lock lever 120 strike against a part of the head bracket 112.

The cutter release lever 116 is locked by the cutter lock lever 120 during a period from starting the push-down of the opening and closing lever 121 to the state shown in FIGS. 4 and 5, however, the lock state of the cutter release lever 116 is released step by step in correspondence to the rotation of the cutter lock lever 120. Since the cutter release lever 116 is always exposed to the energizing force from the cutter release spring 118 as shown in FIG. 5, the leading end of the movable blade 110*c* rotates in a direction moving apart from the fixed blade 108*a* (in a clockwise direction in FIG. 5) in accordance that the lock state is released from the cutter lock lever 120. As a result, the movable blade 110*c* is released from the pressure applied from the fixed blade 108*a*, and the cutter gear 110*f* is detached from the fourth driving force transmission gear 129. As a result, the cutter gear 110*f* becomes in a free state, and the movable blade 110*c* is released from the pressure of the fixed blade 108*a*, and is automatically returned to the home position on the basis of a function of the return spring 110*g*.

On the other hand, the platen bearing 119*a* of the latch lever 119 keeps locking the position of the platen bearing 119*a* during a period from the start of the push-down of the opening and closing lever 121 to the state shown in FIGS. 4 and 5. In other words, it keeps latching the upper frame 102 at the closed position.

As mentioned above, in the printer 10 according to the present embodiment, it is possible to move the movable blade unit 110 while keeping latching the upper frame 102 at the closed position. Accordingly, even in the case that the paper jam is generated and the movable blade 110*c* can not be returned by the driving force of the driving motor 125, it is possible to return the movable blade 110*c* to the home position while keeping the state in which the upper frame 102 is closed. Accordingly, it is possible to avoid the matter that the movable blade 110*c* can not be returned to the home position for the reason that the upper frame 102 is not opened.

Further, in the printer 10 according to the present embodiment, the structure is made such that the driving force transmission path is disconnected by moving the movable blade unit 110. Accordingly, the space required for allowing the movement of the movable blade 110*c* as protruding can be reduced in comparison with the case that the driving force transmission path is disconnected by opening the upper frame as in the conventional structure. In other words, in the printer 10 according to the present embodiment, since the space required in the upper side of the fixed blade unit 108 can be made small, the paper discharge guide 131 (or the cutter cover 130) can be provided close to the fixed blade unit 108. If the distance between the fixed blade unit 108 and the paper discharge guide 131 (or the cutter cover 130) is small, it is possible to reduce a possibility at which the paper goes into the space at a time of being used, and it is possible to prevent the paper jam from being generated. Further, at a time of being maintained, it is possible to reduce a possibility at which a finger of the operator goes into the space, and it is possible to prevent the operator from being injured.

Next, a description will be given of a case that the opening and closing lever 121 is further pushed down from the state in FIGS. 4 and 5, with reference to FIGS. 6 and 7.

Figure 6:
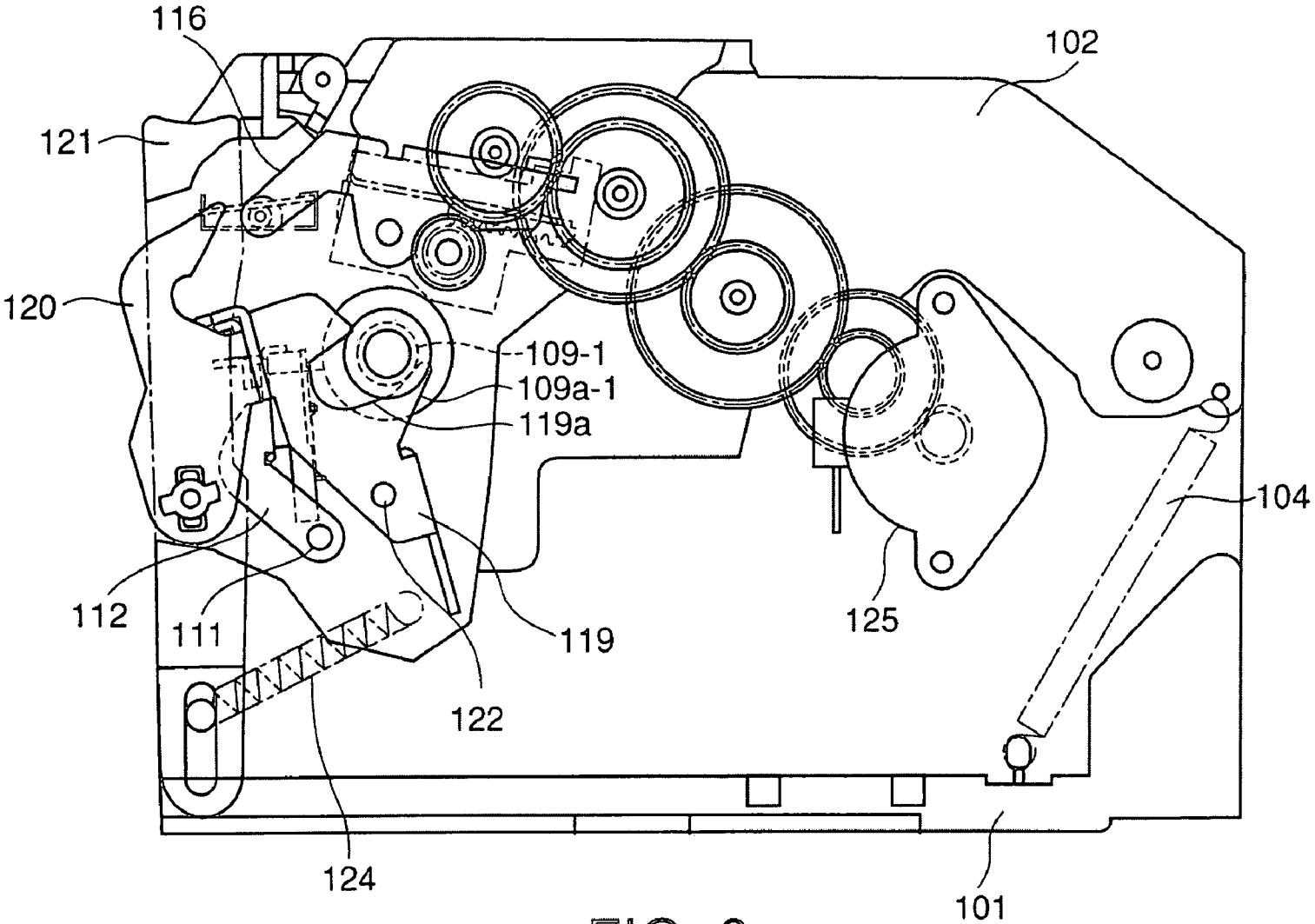
FIG. 6 is a view for explaining a state in which the opening and closing lever of the printer in FIG. 1 is pushed down to a second stage.
Figure 7:
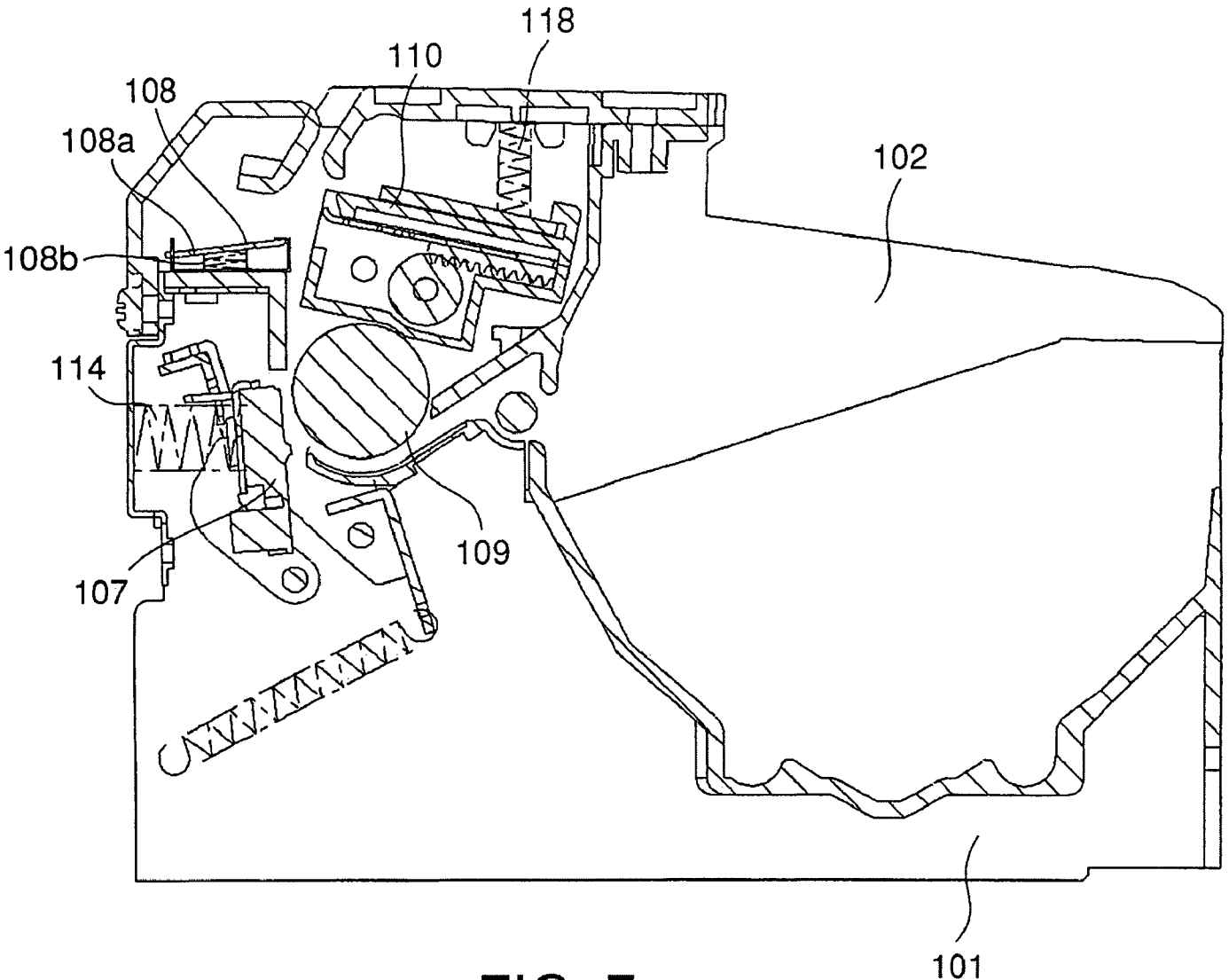
FIG. 7 is a vertical cross sectional view of the center portion of the printer in the state shown in FIG. 6.

FIGS. 6 and 7 are views showing a state of the printer 10 at a time of pushing down the opening and closing lever 121 by a stronger force from the state in FIGS. 4 and 5.

If the opening and closing lever 121 is pushed down by the stronger force, the integrated latch lever 119 and cutter lock lever 120 rotate against the pressing force from the thermal head pressing spring 114 applied to the head bracket 112 in addition to the energizing force of the lock spring 124. In other words, the integrated latch lever 119 and cutter lock lever 120 rotate the head bracket 112 around the head bracket supporting point shaft 111 corresponding to the rotational axis while they themselves rotate around the latch lever shaft 122 corresponding to the rotational axis. Accordingly, the thermal head 107 moves away from the platen 109, and the position lock of the platen shaft 109-1 by the platen bearing 119*a* of the latch lever 119 is canceled. Therefore, the upper frame 102 can movable from the closed position to the open position on the basis of the operation of the opening and closing spring 104. In this case, a lower arm 119*a*-1 of the platen bearing 119*a* pushes up the platen shaft 109-1 in correspondence to the rotation of the integrated latch lever 119 and cutter lock lever 120, and assists an operation that the upper frame 102 moves to the open position.

As mentioned above, in the printer 10 according to the present embodiment, since the latch of the upper frame 102 is canceled after the movable blade unit 110 is moved and the movable blade 110*c* is returned to the home position, the movable blade 110*c* is not exposed to the external portion, and a safely can be improved.

Further, in the printer 10 according to the present embodiment, since the structure is made such that the movable blade unit 110 is attached to the upper frame 102 by using the cutter release lever 116 so as to freely oscillate, it is possible to achieve the disconnection of the driving force transmission path on the basis of the simple and compact structure.

Further, in the printer 10 according to the present embodiment, since the latch lever 119 and the cutter lock lever 120 are integrated, and the single opening and closing lever 121 can execute the latch/latch-cancel of the upper frame 102, and the lock/lock-cancel of the movable blade unit 110, it is possible to return the movable blade 110*c* to the home position without executing any special operation in the case that the paper jam is generated, as well as the structure can be made simple.

Figure 8:
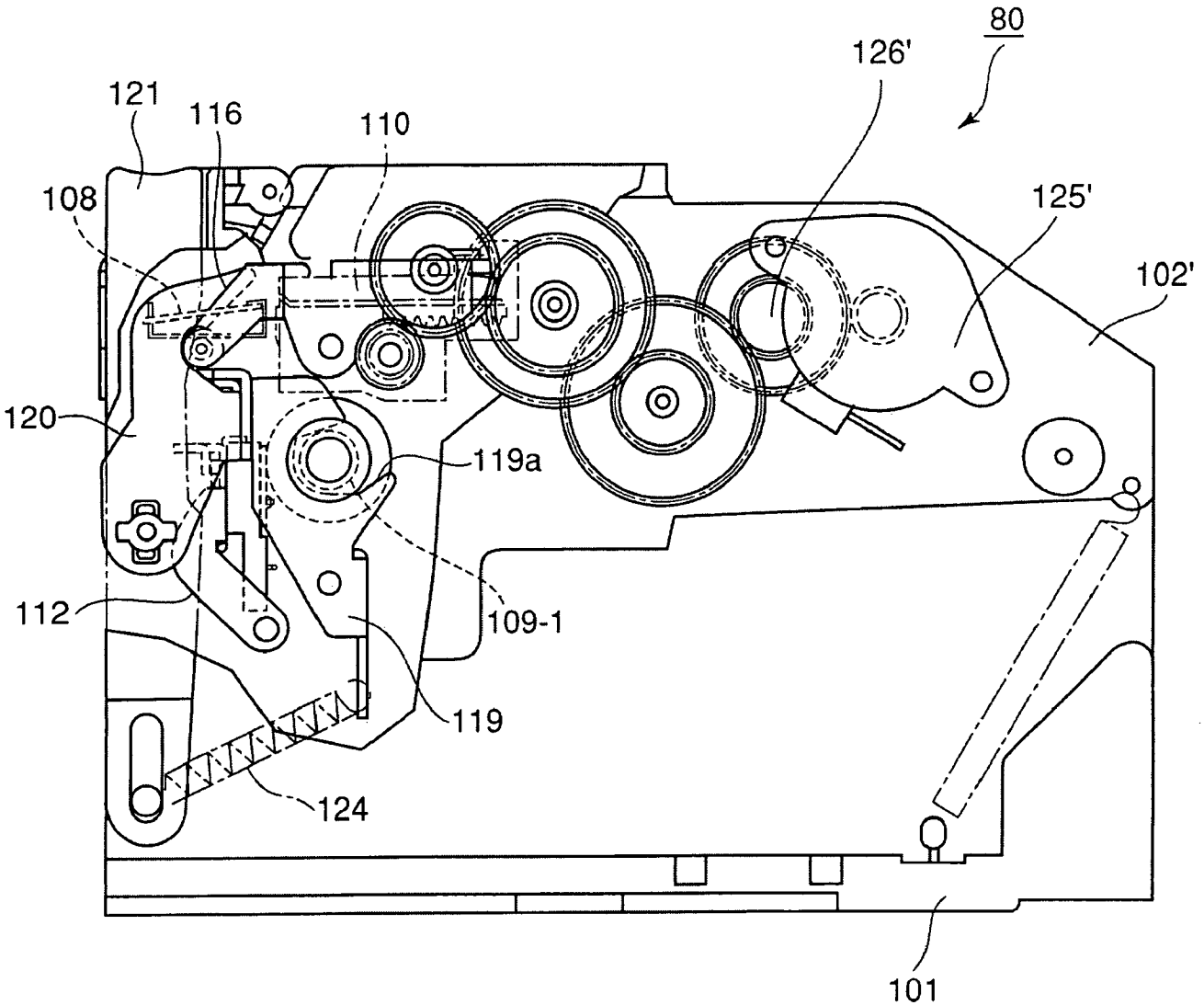
FIG. 8 is a view showing a skeleton structure of a printer according to the other embodiment of the present invention.

Next, a description will be given of a printer 80 according to the other embodiment of the present invention with reference to FIG. 8.

The printer 80 is different from the printer 10 shown in FIGS. 1 to 7 in a point that a cutter driving motor 125' and a driving force transmission gear 126' are provided in an upper frame 102'. An operation of the printer 80 is the same as the printer 10, and the same effect of the printer 10 can be obtained.

In the conventional cutter apparatus, it is necessary to arrange the movable blade and the drive source driving the movable blade in the different frames for disconnecting the driving force transmission path, however, in the present embodiment, the movable blade unit 110 and the cutter driving motor 125' are attached to the same upper frame 102'. As mentioned above, in the printer 80 according to the present embodiment, since it is not necessary to arrange the movable blade unit 110 and the cutter driving motor 125' in the different frames, a freedom of design is large.

The description is given above of the present invention along the preferable embodiments, however, the present invention is not limited to the embodiments mentioned above. For example, the present invention can be applied to the other printing mode printers than the thermal printer, for example, a printer having an ink head in place of the thermal head as the printing head. Further, in the embodiment mentioned above, the lock cancellation of the movable blade unit and the latch cancellation of the upper frame are executed by the common opening and closing lever, however, the structure may be made such that a lever canceling the lock of the movable blade unit and a lever canceling the latch of the upper frame are independently provided, and the cancellation can be respectively executed.

What is claimed is:

1. A cutter apparatus comprising:

an upper frame attached to a base frame so as to be openable and closeable;

a movable blade unit provided in said upper frame; and a driving mechanism for transmitting a driving force from a driving source to said movable blade unit, wherein said movable blade unit is attached to said upper frame so as to be movable, and wherein the cutter apparatus is provided with a cutter lock mechanism which presses a roller attached to a leading end of a cutter release lever coupling said movable blade unit to said driving mechanism by locking said movable blade unit in a state in which said upper frame is closed, and upon transition of said upper frame from the closed to open state, uncoupling said movable blade unit and said driving mechanism by releasing pressure from the roller attached to a leading end of a cutter release lever allowing a moveable blade of said movable blade unit to rotate away from a fixed blade and detach said driving mechanism from a driving force so as to allow said moveable blade unit to move.

2. The cutter apparatus as claimed in claim 1, wherein said movable blade moves forward and backward in a predetermined direction, and is attached to said upper frame by a supporting point shaft extending in a direction orthogonal to said predetermined direction so as to freely oscillate.

3. The cutter apparatus as claimed in claim 2, wherein said cutter lock mechanism includes a spring which always energizes said movable blade unit in a direction of disconnecting said movable blade unit from said driving mechanism.

4. The cutter apparatus as claimed in claim 3, wherein said movable blade unit has a return spring energizing said movable blade toward a home position, and said movable blade is automatically returned to said home position in the case that the coupling between said movable blade unit and said driving mechanism is unlocked.

5. The cutter apparatus as claimed in claim 1, said cutter lock mechanism includes an opening and closing lever allowing said upper frame to move from a closed position to an open position, and the lock of said movable blade unit is unlocked on the basis of an operation of said opening and closing lever before said upper frame moves from the closed state to the open state by operating said opening and closing lever.

6. The cutter apparatus as claimed in claim 5, wherein said cutter lock mechanism has a cutter lock lever locking said movable blade unit and canceling the lock working with said opening and closing lever, and said cutter lock lever is integrated with a latch lever latching in a state of closing said upper frame.

7. The cutter apparatus as claimed in claim 6, wherein said latch lever has an approximately U-shaped platen bearing supporting a rotational axis of a platen rotatably attached to said upper frame, wherein said platen bearing supports said rotational axis even after the lock of said movable blade unit is unlocked substantially in the same manner as that at a time when said movable blade unit is locked, as far as the movement of said cutter lock lever by the operation of said opening and closing lever is within a predetermined range, and wherein said platen bearing releases said rotational axis if the displacement of said cutter lock lever by the operation of said opening and closing lever gets over said predetermined range.

8. A printer comprising the cutter apparatus as claimed in claim 7, wherein the printer comprises:

a printing head;

a bracket attached to said base frame so as to be movable and supporting said printing head; and a pressing spring pressing said printing head along a direction in which said bracket is movable, and wherein when the movement of said cutter lock lever gets over said predetermined range, said latch lever moves said bracket against the pressing force of said pressing spring.

9. An electronic device comprising the printer as claimed in claim 8.

10. The cutter apparatus as claimed in claim 1, wherein said fixed blade is fixed to said base frame, and a cutter cover covering said fixed blade.

11. The cutter apparatus as claimed in claim 1, further comprising a spring always energizing said upper frame in an opening direction.

12. A printer comprising the cutter apparatus as claimed in claim 1.

13. An electronic device comprising the printer as claimed in claim 12.

* * * * *